US005333438A

United States Patent [19]

Gurak et al.

[11] Patent Number: 5,333,438

[45] Date of Patent: Aug. 2, 1994

[54] DUAL COIL POWER STRAPPING MACHINE

[75] Inventors: Ronald W. Gurak, Fox River Grove; Allan J. Bobren, Streamwood; Frank A. Clochon, Mundelein; Janusz Figiel, Mount Prospect; Kenneth W. Lesner, Island Lake; Timothy B. Pearson, Anitoch; Kendall K. Raczek, Chicago; Mark B. Renz, Northbrook; Allen D. Sordyl, Wheeling, all of Ill.

[73] Assignee: Signode Corporation, Glenview, Ill.

[21] Appl. No.: 972,524

[22] Filed: Nov. 6, 1992

[51] Int. Cl.[5] ..... B65B 13/02

[52] U.S. Cl. ..... 53/399; 53/582; 53/589; 100/24; 100/26; 226/109; 226/154

[58] Field of Search ..... 100/24, 26, 29, 32; 53/399, 419, 582, 589; 226/154, 109, 110, 118

[56] References Cited

U.S. PATENT DOCUMENTS

| | | | |
|---|---|---|---|
| 2,915,003 | 12/1959 | Crosby et al. | 100/26 |
| 4,137,788 | 2/1979 | Fischer | 74/242.9 |
| 4,351,463 | 9/1982 | Knecht | 226/154 |
| 4,691,498 | 9/1987 | Stamm | 53/399 |
| 4,724,659 | 2/1988 | Morl et al. | 53/589 |
| 4,955,180 | 9/1990 | Sakaki et al. | 53/589 |
| 5,236,329 | 8/1993 | Sylvester | 53/589 |

FOREIGN PATENT DOCUMENTS

| | | |
|---|---|---|
| 0195345 | 9/1990 | European Pat. Off. . |
| 118037 | of 0000 | Fed. Rep. of Germany . |
| 157086 | of 0000 | Fed. Rep. of Germany . |
| 2741711 | 4/1978 | Fed. Rep. of Germany . |
| 2837164 | 3/1980 | Fed. Rep. of Germany . |
| 3019929 | 12/1981 | Fed. Rep. of Germany . |
| 3825668 | 2/1990 | Fed. Rep. of Germany . |
| 1213107 | 2/1988 | Japan . |

OTHER PUBLICATIONS

Translation of German Patent Application P3825668.1. Declaration executed by Hans Seiler and Translation "Device for Feeding Band-Shaped Packing Material", German Patent 157086.

English language abstract corresponding to DE3019929.

English language abstract corresponding to DE2837164.

*Primary Examiner*—W. Donald Bray

*Attorney, Agent, or Firm*—Schwartz & Weinrieb

[57] ABSTRACT

An improved power strapping machine comprising a strapping device and a soft touch package compression device. The strapping device includes plurality of coils for supplying strapping to a guide apparatus. A chute apparatus for routing strapping around an article or package to be strapped is connected to the guide apparatus. The machine includes sensors and a control circuit adapted to operate the machine continuously without the need to stop production, since when one coil is out of strapping or a misfeed occurs, the machine will automatically load another coil of strapping and continue strapping packages. The soft touch package compression device uses pneumatic-drive chain drive systems for moving soft belts up and down. The soft belts compress the package so that the strapping device can place a tight strap around the package.

45 Claims, 4 Drawing Sheets

190
20
112
R
Y
G
W
81
157
6
122
4
130
24
148
159
158
156
81
44
52
52
156
115
49
46
50
128
4
168
128
154
164
164
150
162
22
162
150
160
134
134
38
144
160
156
55
42
156
157
158
30
111
74
76
110
40
132
36
146
106
116
60
78
61
118
120
75
26
114
48
170
152
90
76
108
98
99
96
62
63
100
6
94
104
38
102
64
96
63
98
92
54
52
188
28
108
34
32
188

DUAL COIL POWER STRAPPING MACHINE

FIELD OF THE INVENTION

The present invention relates to packaging machines, and, more particularly, to machines for applying a strapping material around an article or articles to be packaged.

BACKGROUND OF THE INVENTION

Conventional power strapping machines for strapping packages use a strapping device in tandem with a compression device. Typical prior art designs present many problems which vastly affect cost and efficiency. The present invention is intended to overcome these problems.

Many prior art strapping devices use a single coil of strapping that is connected to a guide track. The guide track is connected to a chute that is used for routing the strapping around a package. The strapping is then stripped out of the chute. The guide track has an accumulator box included in the design for storing extra strapping that is fed into the machine while the package is being strapped and for storing strapping that is taken up while the strapping is being tightened.

The usage of single coil of strapping presents a fundamental problem in itself. When the coil is out of strapping, the operator must manually reload a new coil of strapping. To do this, the machine must be taken off line, thereby wasting valuable production time. Several other problems arise in the prior art. The use of a single accumulator box for storing extra strapping that is fed in during the strapping process and for storing strapping that is taken up when the strapping is tensioned around a package can cause tangles in the strap in the box. The strap that is brought in from the tensioning and the extra strapping being fed in, tend to rub against each other and tangle. When a tangle occurs, the operator must stop production and manually untangle the strapping.

Prior art designs have also had problems with devices that sense whether the accumulator box is too full to accept more strapping. Some designs use mechanical switches that are operated by the physical strength of the strapping. This design, however, is not reliable, since it varies with the different operating conditions present, such as, for example, temperature, humidity, and the force required to operate the mechanical switch. Other prior art designs use a photo electric eye and reflector system. This design is not reliable, however, because dust and contaminants can interfere with the system.

Another problem in typical prior art designs is the usage of a chute that must have the strapping stripped out in order to tension the strap around the package. Stripping can cause nicks in the chute which shortens the life of the chute and can cause short feeds and presealing to occur.

Prior art compression devices also present many problems. The typical prior art compression device uses a single solid bar to compress the package so that the strapping device can tension the strap tightly around the package.

This solid bar, by itself, presents a safety hazard. Often, if the operators need to place their hands in the compression path for any reason, the hands will be crushed by the solid bar.

Also, the use of a single compression device on one side of the package centerline causes the strap to be placed on the package in a butterfly configuration. The butterfly configuration can contribute to the strap becoming loose during transit.

The present invention is intended to overcome or minimize all of these problems, as well as to present several other improvements.

OBJECTS OF THE INVENTION

A general object of the present invention is to provide an improved power strapping machine for strapping packages.

It is an object of the present invention to provide a novel power strapping machine having multiple supply coils that will automatically switch from one coil of strapping to another coil of strapping without operator intervention, thereby eliminating the need to stop production.

It is an object of the present invention to provide a novel power strapping machine that is more reliable, stronger, faster, and more efficient than previous designs.

A further object of the present invention is to provide a power strapping machine that is portable.

Still another object of the present invention is to provide a power strapping machine that can detect problems in the strapping process and alert the operator.

It is also an object of the present invention to provide a strapping device incorporating a novel chute assembly which is constructed so as to eliminate the need to strip the strapping from the chute apparatus.

A more specific object of the present invention is to provide a strapping device that uses a novel gate configuration for guiding strapping to the chute apparatus.

Another specific object of the present invention is to provide a compression device that will allow the strapping to be placed tightly around the centerline of the package.

It is a further object of the present invention to provide a package novel compression device that eliminates safety hazards.

SUMMARY OF THE INVENTION

Briefly, and in accordance with the foregoing, the present invention comprises a strapping device which includes a plurality of coils for supplying strapping to a guide apparatus. A chute apparatus for routing strapping around an article or package to be strapped is connected to the guide apparatus. The use of a plurality of coils allows the machine to run continuously without the need to stop production, since when one coil is out of strapping or a misfeed occurs, the machine will automatically load another coil of strapping and continue strapping packages.

Preferably, the machine further includes a soft touch package compression mechanism which uses pneumatic-driven chain drive systems or flexible compression members for moving soft compression members or belts to and from an article or package compressing position so that the strapping device can place a tightened strap around the package.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements through the several views, and in which.

DETAILED DESCRIPTION OF THE PREFERRED EMBODIMENT

Figure 1:
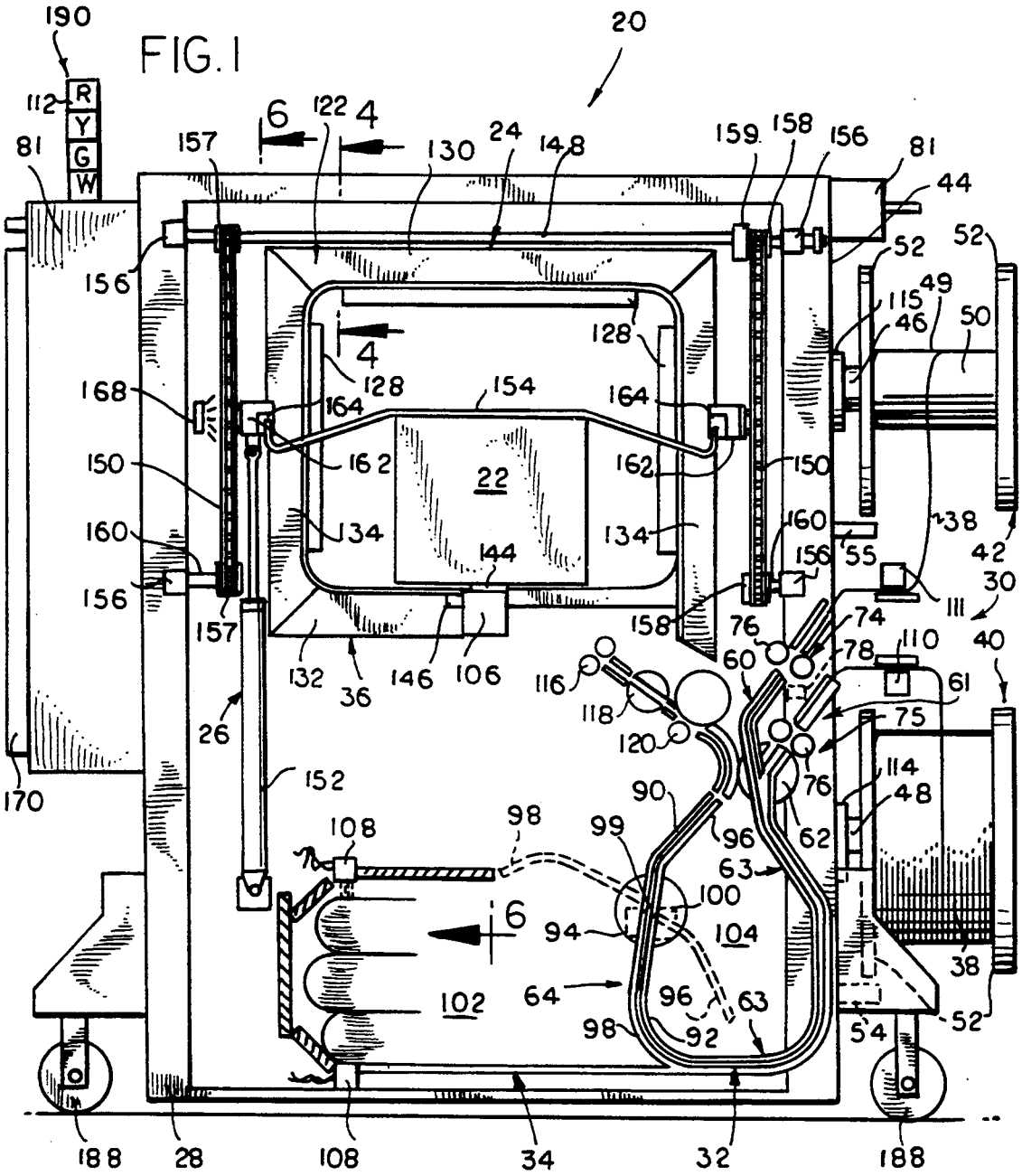
FIG. 1 is a simplified front elevational view, partially broken away, of a dual coil power strapping machine according to the present invention.

While the invention may be susceptible to embodiment in different forms, there is shown in the drawings, and herein will be described in detail, a specific embodiment with the understanding that the present disclosure is to be considered only an exemplification of the principles of the invention, and is not intended to limit the invention to that as illustrated and described herein.

A dual coil power strapping machine, generally designated at 20, is adapted to strap a package or article 22, such as, for example, a single article or a bundle of newspapers, magazines or any other articles, and includes a strapping device or mechanism, generally designated at 24, and a soft touch package compression device or mechanism, generally designated at 26. The strapping device 24 will be described in detail first, and then the soft touch package compression device 26 will be described in detail.

With reference still being made to FIG. 1, the strapping device 24 is generally comprised of a frame, support or workstation 28, a coil apparatus or assembly 30, a guide apparatus or assembly 32, a storage compartment apparatus or assembly 34, and a chute apparatus or assembly 36. The strapping device 24 is used to feed a strap 38 around a package 22, and to then tighten the strap 38 securely around the package 22.

Figure 2:
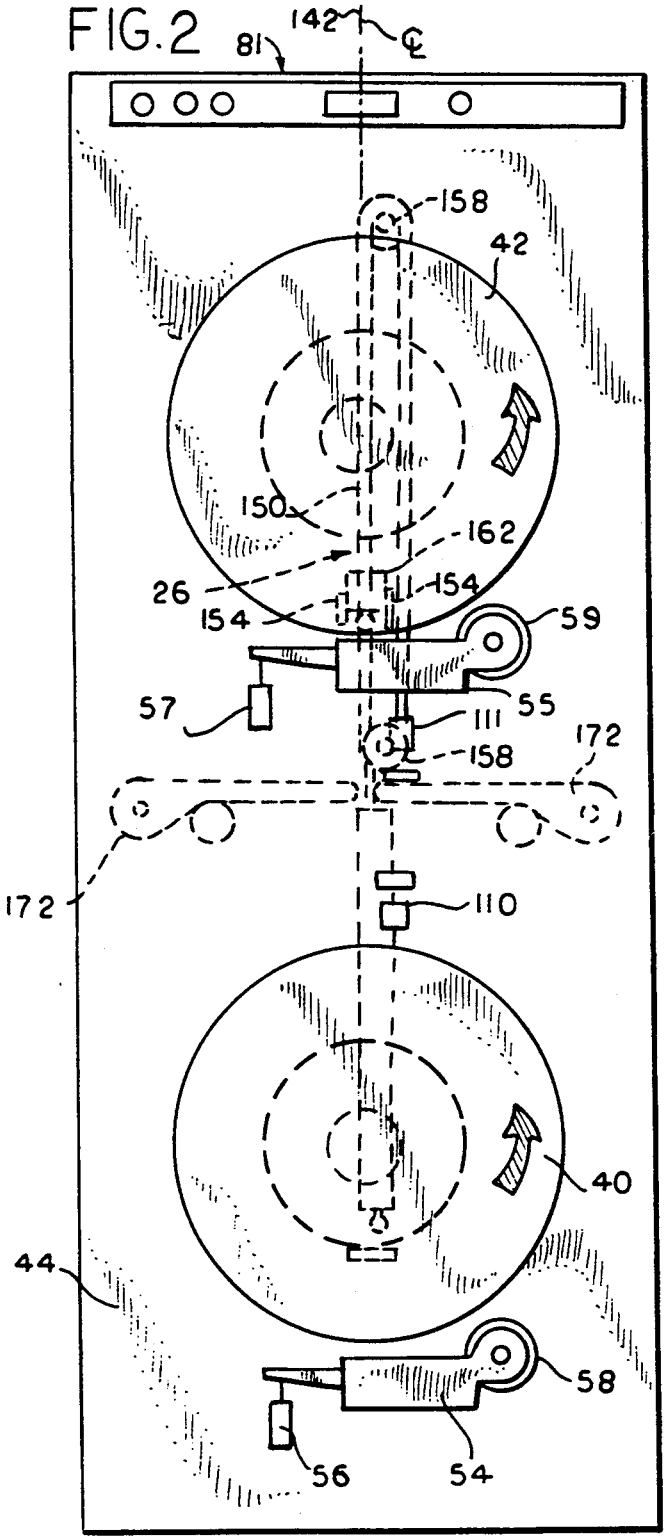
FIG. 2 is an enlarged simplified side view of the dual coil power strapping machine, with a soft touch package compression device shown in phantom.

As shown in FIG. 2, the coil apparatus 30 comprises two coils 40 and 42 that are rotatably mounted to a side 44 of the frame 28 by shafts 46 and 48. The coils 40 and 42 can rotate in a clockwise or counterclockwise direction. Each coil 40 and 42 is comprised of a spool 49, including a core 50 with two end flanges 52. The coils 40 and 42 are designed to hold a length of strapping 38, comprised of a material such as polypropylene, which is wound around the core 50 for feeding into the machine 20.

Each coil 40 and 42 can hold a length of strapping 38 that will keep the machine 20 operating for many continuous hours. After one coil has been completely used, the machine 20 is constructed for automatically switching over to the other coil and continuing the strapping of packages 22 without any operator intervention. The operator can then load a full coil of strapping 38 onto the machine 20 at any time during operation of the other coil. This automatic switch-over ability of the present invention presents an advantage over prior art machines, which require that the operator stop the strapping production of the machine while manually loading a full coil of strapping.

As shown best in FIG. 2, coils 40 and 42, respectively, have separate coil rewind motors 54 and 55. These motors 54 and 55 are used to rewind the strapping 38 onto the coil 40 or 42 when the machine 20 has a malfunction, as discussed more fully below, such as a strap short-feed condition. Each motor 54 and 55 is attached to the side 44 of the frame 28 below its respective coil 40 or 42. The motors 54 and 55 have a linear solenoid 56 and 57, respectively, that pivots the motor, thereby engaging a friction wheel 58 or 59 against the coil 40 or 42 in order to rotate the coil for rewinding the strapping 38.

The strapping 38 must be rewound after a malfunction, because long lengths of strapping 38 may have been fed into the machine 20. Rewinding the strapping 38 onto the coil 40 or 42 will prevent the strapping 38 from tangling inside the machine 20, and also prepares the coil 40 or 42 for the operator to reload the strapping 38 into the machine 20.

The strapping 38 is fed off from the coils 40 and 42 and then into a guide assembly 32 that is located inside the frame 28. The guide apparatus 32 is generally comprised of three branches 60, 61, and 63, a gate 62, and a rotating guide 64 (see FIGS. 1 and 3).

Each of the branches 60 and 61 of the guide assembly 32 includes two guides 66 and 68 sitting side by side, with a sufficient distance between the guides 66 and 68 to allow the strapping 38 to pass therethrough. The two outside guides 66 of the two branches 60 and 61 converge to form the guides 70 of the third branch 63. The inside guides 68 of the two branches 60 and 61 end at a converging point 72. Thus, no interruption in the guide apparatus 32 exists.

The straps 38 are fed from the coils 40 and 42 into branches 60 and 61, respectively, of the guide apparatus 32. Adjacent to branches 60 and 61 are strap feed mechanisms 74 and 75, respectively. These mechanisms 74 and 75 advance each strap 38 into the guide apparatus 32 after the straps 38 have initially been manually fed into the machine. Each strap feed mechanism 74 and 75 comprises two rotatable rollers 76 disposed side by side with a sufficient distance between the rollers 76 to allow the strap 38 to pass therethrough. Both mechanisms 74 and 75 are rotated or driven by the same electric motor 78 through separate belts, not shown. Each strap 38 travels through the rollers 76 along its respective branch 60 or 61 of the guide apparatus 32 until the straps 38 reach the gate 62.

Figure 3:
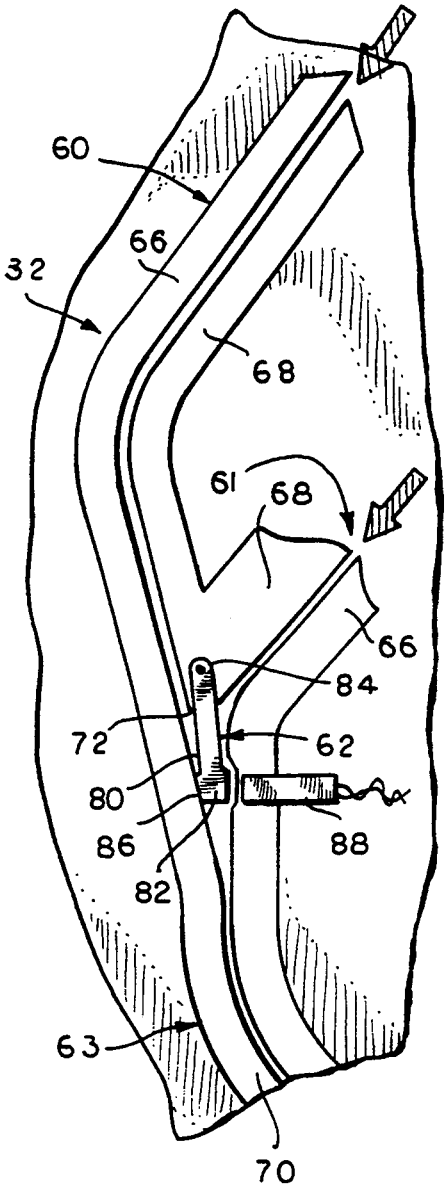
FIG. 3 is an enlarged fragmentary view of the Y gate of FIG. 1.

The gate 62, as best shown in FIG. 3, is generally in the shape of a lever. The gate 62 is located at the point 72 where the two branches 60 and 61 converge into the third branch 63, and is comprised of a pivotally-mounted arm 80 with a head end 82. The gate arm 80 is pivoted on pin 84 near the point 72, so that the head end 82 is movable between the guides 70 of the third branch 63. The gate arm 80 is free-moving in response to engagement by a strap 38. The arm 80 is adapted to pivot in response to a pushing action by whichever strap 38 is fed first until the head 82 contacts a slot or stop portion 86 in an opposite guide 70. When the head 82 contacts the slot 86, a path that is only wide enough to allow one strap 38 at a time to pass therethrough is opened, and the strap 38 that caused the rotation of the arm 80 is allowed to pass therethrough to the third branch 63.

The gate 62 also includes a proximity sensor 88 associated with the arm 80. The proximity sensor 88 is located adjacent the head 82 of the arm 80 and senses which position the arm 80 is in so as to provide a signal identifying which strap 38 is being fed through the gate 62. This sensor 88 automatically sends a signal to the machine's electrical control system 81 (see FIG. 2) so as to determine which strap feed mechanism 74 or 75 to energize, and the machine 20 accordingly drives that mechanism 74 or 75. The control system 81 may include a properly programmed microprocessor and suitable relays and switches of known construction, not shown, for activating the various drive mechanisms incorporated into the machine.

Part of the third branch 63 passes directly through the storage compartment apparatus 34. This part of the third branch 63 has an upper fixed section 90 and a lower fixed section 92 upon opposite sides of the strap path of travel therebetween. The sections 90 and 92, respectively, cooperate with opposite movable guide sections 96 and 98 attached to a pivot 94 so as to provide a track for the strap 38. Thus, when the pivot 94 is rotated in the clockwise direction, the guide section 96, located at one side which may be designated the front side of the strap path of travel, rotates from the solid line position shown in FIG. 1 into one side 104 of the compartment assembly or strap accumulator box 34, as shown in broken lines. The guide section 98, located at the opposite or back side of the strap, rotates into the other side 102 of the compartment assembly or box 34. A space 99 is left between the fixed guide sections 90 and 92, and also the rotated guide sections 96 and 98, so as to allow the strap 38 to pass therethrough. This unique feature is called the rotating guide 64.

The rotating guide 64 is rotated by a pneumatic rotary actuator 100, such as an air motor. The air motor 100 is activated by the control system 81 so that the areas 102 and 104 are automatically separated from each other when the machine 20 is being fed strapping 38 from the coil 40 or 42 upon initial cycle startup or cycle startup after a misfeed. No human intervention is required to rotate the guide 64 into position.

The strap storage area 102 is adapted to retain extra strapping 38 that is waiting to be fed into a strapping head 106 for the next package 22. The strapping head 106 is of known construction, such as that disclosed in the Signode® NEWS90 Power Strapping Machine Operation, Parts and Safety Manual, and its disclosure is incorporated herein by reference. The strap take-up area 104 stores the strap 38 that is taken up or pulled back when the strap 38 is tensioned around the package 22. This structure minimizes the possibility of faulty feeding of the strap, such as may occur in prior art machines having an undivided storage or accumulator box. The use of an undivided box may cause problems with feeding the strap for the next package, because the strap which has been pulled back into the box from the previous tensioning step tends to rub against the strap feeding into the machine from one of the supply coils and may cause jams in the accumulator box.

Included in the strap storage area 102 is a photoelectric emitter and receiver sensor 108 of a known construction, which is in communication with the control system 81. This sensor 108 senses when the storage area 102 is full of strap 38. The strap feed mechanism 74 or 75 will feed strap 38 into the strap storage area 102 until the beam that is emitted from the sensor 108 is broken. When the beam is broken, the sensor 108 sends a signal to the control system 81, and the control system 81 signals the strap feed mechanism 74 or 75 to stop feeding strap 38 into the storage area 102. As the strap 38 is used, the strap 38 in the storage area 102 moves out of the path of the beam. When the beam is uninterrupted, the control system 81 signals the strap feed mechanism 74 or 75 to start feeding strap 38 into the storage area 102 again.

Before the strap feed mechanism 74 or 75 is stopped from rotating by a signal from the photoelectric emitter and receiver sensor 108, the coil 40 or 42 must be stopped from rotating so as to prevent the coil 40 or 42 from feeding excessive strap 38 into the strap storage area 102, and to prevent the strap 38 from being excessively discharged from the coil 40 or 42 and becoming entangled with itself. This is accomplished by activating an electromechanical brake 114 or 115 that is attached to an end flange 52 of the coils 40 and 42, respectively.

The photoelectric emitter and receiver sensor system 108 is more reliable than current and previous mechanical switches, because the mechanical switches are operated by the physical strength of the strap which varies with the different operating conditions present, such as, for example, temperature, humidity, and the force required to operate the mechanical switch. In addition to the above advantage, the photoelectric emitter and receiver sensor system 108 functions such that dust and contaminants are not as likely to interfere with its operation.

Another sensor that is utilized in the machine 20 is an out-of-strap switch proximity sensor. The coils 40 and 42, respectively, have associated out-of-strap switches 110 and 111 through which strap 38 is fed before entering the strap feed mechanisms 74 and 75. This sensor serves several functions.

The out-of-strap switch proximity sensors 110 and 111 sense when the coil 40 or 42 is out of strap. When this condition is sensed, the switch 110 or 111 is activated and signals the control system 81 so that the machine 20 automatically stops the strap feed mechanism 74 or 75 from pulling strap 38 into the machine 20. This prevents the trailing end of the strap 38 pulled from a spool from entering the machine 20. The trailing end of the strap 38 is usually deformed from the manufacturing process and can cause problems in the guide apparatus 32. This presents an advantage over the prior art, because previous designs allow the trailing end of the strap 38 to enter the machine.

After the out-of-strap switch 110 or 111 has been activated, the machine 20 continues to strap packages 22 until the strap storage area 102 is empty. The machine 20 then automatically reverses the strap feeding mechanism 74 or 75 associated with the empty coil 40 or 42, and the remaining short piece of strap 38 that remains in the strap storage area 102 is expelled from the machine 20. This is another improvement over prior art machines, because the remaining piece of strap in current machines remains in the strap storage area and needs to be physically removed by the operator. This action requires the machine to be taken out of production.

After the short, terminal end portion of the strap 38 is expelled from the machine 20, the control system 81 sends a signal to the rotating guide 64 and the rotating guide 64 rotates from the broken line position shown in FIG. 1 to the full line position for directing the strap directly through the box without entering the storage area 102. The control system 81 then sends a signal to the other strap feed mechanism 74 or 75 to start rotating and the other coil 40 or 42 of strap 38 is rotated so as to feed its associated strap 38 into the machine 20 without operator intervention, whereby the machine 20 stays in production. Therefore, the coil 40 or 42 being used can be run completely used without stopping production.

When the associated out-of-strap switch 110 or 111 is actuated at the end of the strap of either coil 40 or 42, the switch turns on an indicator light 112 of control system 81 so as to alert the operator that the machine 20 needs a fresh coil to be loaded.

After the strap 38 is fed through the rotating guide 64 of the third branch 63, the strap 38 passes between tension drive wheels or rollers 120, through a high tension winder 118, and between feed drive wheels or rollers 116 before it reaches the strapping head 106. The feed drive 116, the high tension winder 118, and the tension drive 120 are of known construction, such as disclosed in the Signode ® NEWS90 Power Strapping Machine Operation, Parts And Safety Manual, which disclosure is incorporated herein by reference.

Once the strap 38 passes through the strapping head 106, the strap 38 enters the chute apparatus 36. The chute apparatus 36 guides the strap 38 around the package 22. The chute apparatus 36 is generally comprised of a frame 122, a track 124, air cylinders 126, and brushes 128.

The frame 122 has a generally loop shape, through which the package or article 22 may pass. The frame 122 is comprised of a top section 130, a bottom section 132, and two side sections 134. Opposite ends of each of the side sections 134 are bolted at a corner with an end of the top section 130 and the bottom section 132 for enhancing the strength of the frame 122.

The inner corners of the frame 122 are curved. This curved frame 122 allows for minimizing the frame size required to encompass the package 22. Therefore, the package 22 throughput is increased, because the strap feeding distance and strap take-up time is reduced due to the smaller size of the frame 122.

The track 124 runs along the entire length of the inside of the frame 122. This track 124 is comprised of two pieces 136 and 137 sitting side by side along each of the side, top, and bottom sections of the frame 122 and two curved corner track pieces 138. Each piece 136 and 137 of the track 124 is connected at its opposite ends to a pneumatic drive 126, such as, for example, the aforenoted air cylinder, by way of the curved corner track pieces 138 for shifting the complementary track members 136 and 137 toward and away from each other between closed and opened positions. Each piece of the track 136 and 137 also has a slot 140 that runs the entire length of the track 124 for accommodating the strap 38.

Figure 4:
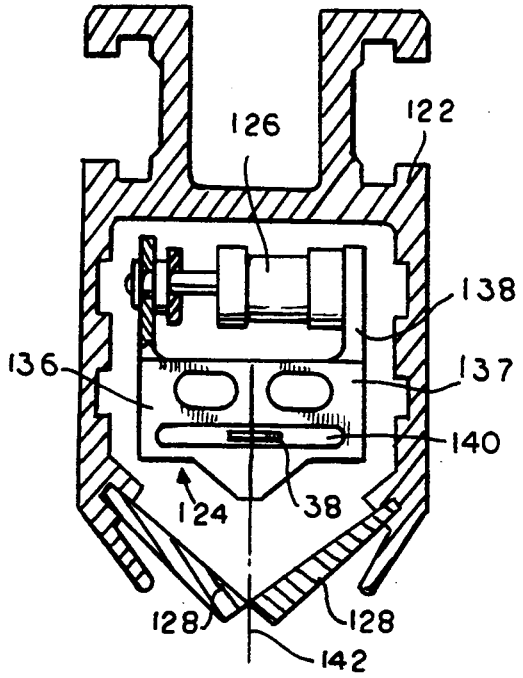
FIG. 4 is an enlarged cross-sectional view of FIG. 1 taken along line 4—4, wherein the device is closed.
Figure 5:
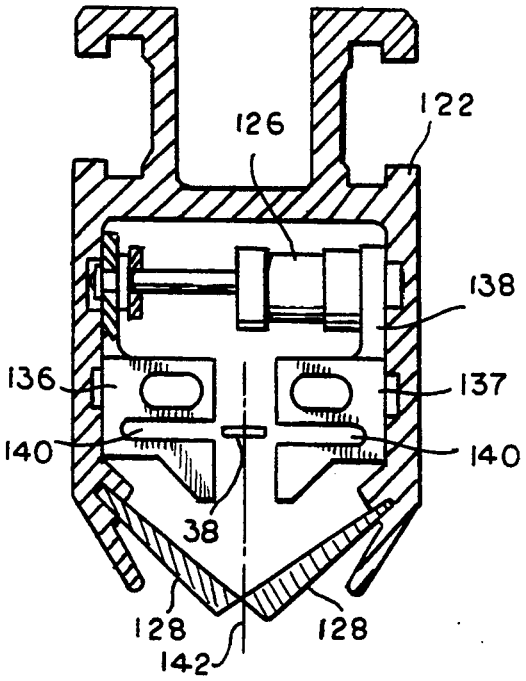
FIG. 5 is a view similar to FIG. 4, wherein the device is open.

When the track 124 is in the closed position, as shown in FIG. 4, the track pieces 136 and 137 abut each other and the slots 140 in each piece of track 136 and 137 form a path for the strap 38. The present invention has a wide slot 140 for the strap 38 in order to allow the use of a cambered strap. This helps to eliminate feed problems due to strap camber. The strap camber can now flow in either direction about the strap centerline 142.

The air cylinders 126 are used to open and close the track pieces 136 and 137. The track pieces 136 and 137 are located at opposite sides of the strap centerline 142. When the track pieces 136 and 137 are separated, the gap between the pieces of track 136 and 137 is wider than the width of the strap 38. Thus, the strap 38 is free to fall out of the slot 140. Therefore, when the track 124 is opened, the strap 38 may be removed in a manner such that virtually no wear is incurred on the track 124 or the strap edge, because the strap 38 is not stripped from the track 124. This eliminates problems found in the prior art from the strap causing nicks in the chute edge, which in turn causes short feeds and pre-sealing.

When the track pieces 136 and 137 are separated, the strap 38 falls out of the slot 140 onto soft, flexible, retaining elements, such as brushes 128, which are attached to the top and side pieces 130 and 134 of the frame 122. The brushes 128 are made of a soft and flexible material, and are angled inwardly about the strap centerline 142 for maintaining the strap 38 in a centered position.

The use of soft, flexible, retaining elements or brushes 128 at both sides of the strap centerline has several advantages over prior art systems. First, considerably lower strap tensions are attainable because the strap 38 does not have to be tightly tensioned so as to open the chute apparatus 36 in order to permit stripping of the strap from the track. The strap 38 may be easily pulled through the soft brushes 128 after the pieces of track 136 and 137 have been opened by the air cylinders 126. The required tension to pull the strap 38 through the soft brushes 128 is much less than that required to strip the strap 38 from a conventional chute. Second, the brushes 128 prevent the strap 38 from falling into the package path when the chute apparatus 36 opens before the package 22 is in position for strapping. Third, the brushes 28 are placed about the strap centerline 142 and are angled inwardly so as to help prevent the strap 38 from twisting on the, package 2. Also, the brushes 128 control the way the strap 38 slips onto the package 22 by allowing the strap 38 to encompass the package 22 from all sides at the same time, thereby helping to control and prevent edge damage to the package 22.

Another feature included in the chute assembly 36 is a strap proximity timer which is set for a predetermined time and a strap proximity sensor unit 144 located adjacent the head 106. This timer is triggered when the machine 20 begins feeding. The timer then gives the strap 38 a specified amount of time to travel around the path of the track 124 and back to the head 106 and timer sensor unit 144. If the sensor 144 is not tripped by the strap 38 completing the loop in the specified amount of time, the timer and sensor unit 144 register a short feed. A signal is sent to the control system 81 for energizing the appropriate motor 54 or 55 and the strap 38 is rewound upon either the coil 40 or 42 and the other coil 40 or 42 is fed as discussed previously.

Another feature of the chute apparatus 36 is the inclusion of a sensor 146 positioned on the track 124 that senses whether the chute is open or closed. If the chute is open for any reason, the sensor 146 signals the control system 81 for preventing the strap 38 from feeding into the track 124. If the chute is closed for any reason, the sensor 146 signal prevents the strap 38 from being tightened around the package 22.

Turning now to the specifics of the soft touch package compression device 26, as shown in FIG. 1, the device generally comprises a horizontal transfer bar or shaft 148, two vertical chain drives 150, an air cylinder 152, and two relatively soft or flexible compression elements, such as belts 154. These soft elements 154 are positioned one on each side of the strap 38 centerline 142. The soft touch compression device 26 is adapted to compress each package 22, so that the strap feed device can place a tightened strap around each package 22.

The horizontal transfer shaft 148 is mounted by bearings 156 at each end of the transfer shaft 148 to the frame 28. The transfer bar or shaft 148 is rotatable with respect to the frame 28 and is mounted on frame 28 at a height greater than the height of the package 22 to be compressed. The shaft also has a length greater than the width of any package 22 to be compressed.

Two vertical, endless chain drives 150 are engaged by sprockets 157 and 158 at opposite ends of the shaft 148. Sprocket 157 is fixed to the shaft 148 while sprocket 158 can rotate with respect to the shaft 148. The upper end of each chain drive 150 is attached near the end of the transfer shaft 148 at a distance greater than the width of any package 22 to be compressed. The bottom end of each chain drive 150 encircles a sprocket 157 or 158 mounted on a bar or shaft 160, which is mounted to the frame 28 by a bearing 156. Sprocket 157 is fixed to the bar 160 while sprocket 158 can rotate with respect to the bar 160. The shaft 160 is rotatable with respect to the frame 28.

A compression carriage 162 is attached to each of the chain drives 150 for holding the ends of two relatively soft, flexible belts 154 at a position beneath the transfer shaft 148. On the end of the transfer shaft 148 opposite the air cylinder 152 and attached to the sprocket 158 is a sprocket phase adjuster 159 of known construction. This device can control the relative position of the carriages 162 with respect to each other by allowing relative motion between the chain drive 150 of one end of the shaft 148 and the chain drive 150 of the other end. This phase adjuster 159 positions one carriage 162 higher or lower than the other carriage 162 so as to allow the soft belts 154 to conform to packages 22 if the packages 22 are non-compensated. Non-compensated packages 22 are not horizontal across their top surface. For packages 22 that are compensated with their top surface more or less horizontal, each carriage 162 is located at substantially the same horizontal position relative to the package 22 to be compressed.

The soft belts or compression elements 154 of the present invention present several advantages over the prior art systems. The soft belts 154 of the present invention minimize risk of injury to an operator. Also, because the solid bar has been eliminated in the present invention, excess weight has been eliminated, which allows the device to operate faster and contributes to increased throughput of the machine.

A single air cylinder 152 is connected to one of the compression carriages 162. The air cylinder 152 is used to drive both chains 150 in unison through the shaft 148 in an up and down motion, which in turn causes the belts 154 to move in an up and down motion for compressing a package 22 in its path.

Each carriage 162 also has an automatic tensioning device 164. Each soft belt 154 is automatically tensioned after the belt 154 is installed in its carriage 162. This allows the belt 154 to be kept tight, even as the belt 154 stretches with age and use. This eliminates the possibility of the belt 154 sagging into the package path when the belt 154 is in the raised position waiting for the package 22 to enter the strapping position. The automatic tensioning device 164 also reduces maintenance requirements for the machine 20.

Figure 6:
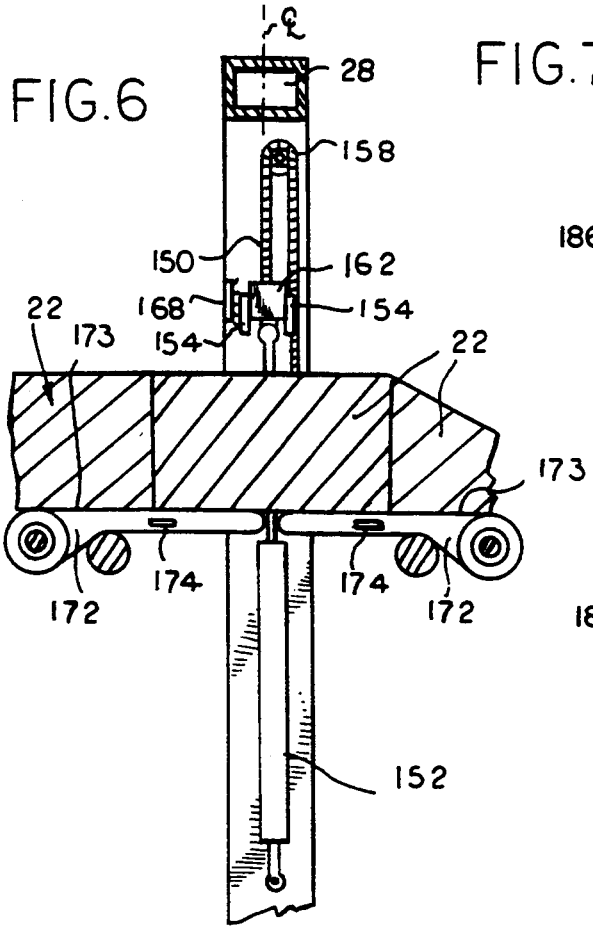
FIG. 6 is a cross-sectional view of FIG. 1 taken along line 6—6.
Figure 9:
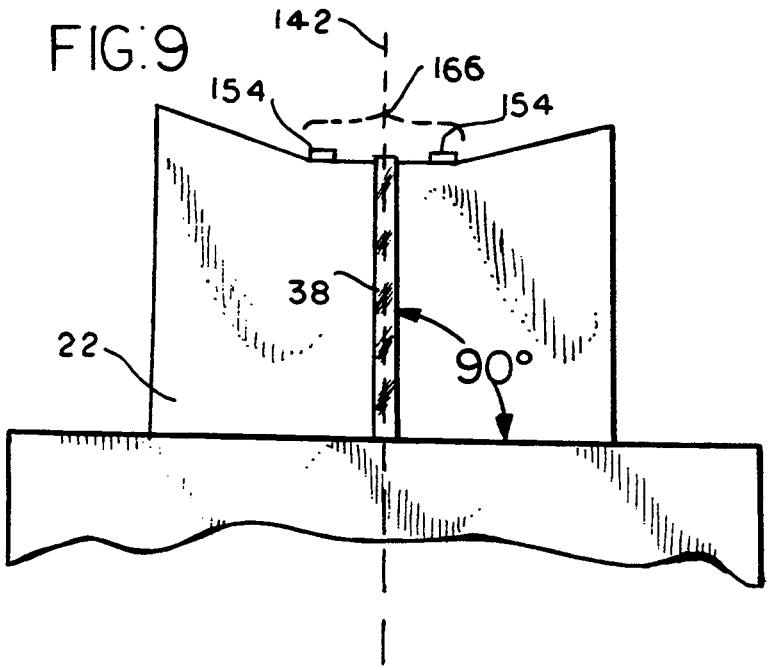
FIG. 9 is a simplified side view of a package that is being compressed by the soft touch compression device.

The machine 20 is preferably constructed so that a soft belt 154 is located on each side of the strap centerline 142 and as close as possible to the strap centerline 142, as shown in FIGS. 2, 6, and 9. As shown in FIG. 9, pressure is applied by the belts 154 on both sides of the strap centerline 142, and this allows the belts 154 to create a relatively flat region 166 for the strap 38 to be tensioned around. This flat or symmetrical top region 166 prevents the top of the package 22 from forming a butterfly configuration during compression, as when a single compression device is used. The butterfly configuration of the prior art could cause the strap to be installed at an angle of less than 90° with respect to the table or conveyor top, which could contribute to straps becoming loose during transit. The present invention maintains tighter, more secure strap tension on the package 22, because the strap 38 is applied in a substantially vertical position along the sides of the package and with respect to the table top.

Another feature of the soft touch compression device 26 is an upstream sensor 168 that senses the height of the next incoming package 22, as shown in FIGS. 1 and 6. This sensor 168 signals the control system 81 for actuating the cylinder 152 so as to pre-position the belts 154 before the package 22 is in a position for strapping. This allows the belts 154 to travel a minimum distance and time to reach the top of the package 22 during an actual strapping operation. This increases package 22 throughput of the machine 20, especially when the packages 22 are relatively small in height and coming out of the stackers at a faster rate of speed.

Figure 7:
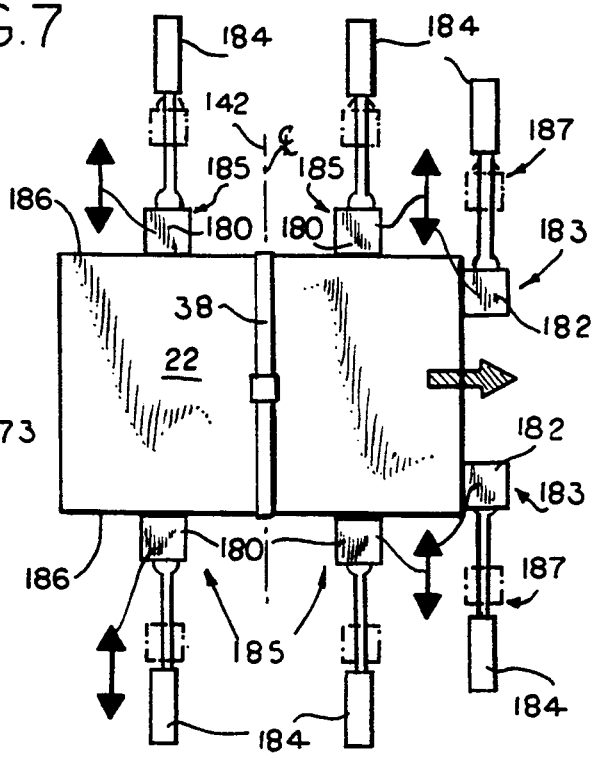
FIG. 7 is a simplified top view of a package and package conditioners and stops.

The machine 20 uses conveyors 172 having endless belts 173 which are located on both sides of the chute apparatus 36 for moving a package 22 in and out of the machine 20 as shown in FIGS. 2, 6 and 7. These conveyors 172 have non-contacting sensors 174, see FIG. 6, on each conveyor 172. The sensors 174 sense whether a package 22 has entered the machine 20, and signals the control system 81 that a package 22 is in a correct position at the work station so as to be strapped. The sensors 174 do not contact the package 22 when the package 22 enters the machine 20. Prior art systems have used a mechanical device that physically contacts the package and can interfere with low and lighter weight packages. Since the conveyors 172 have sensors 174 located on both sides of the strap centerline 142, either side of the machine 20 can be used as the entry side. This presents another advantage over the prior art, because the present invention can be programmed from the keypad 170 operate so as to accept either a right or left-hand package flow, whereas, the prior art only allows operation from one direction.

Figure 8:
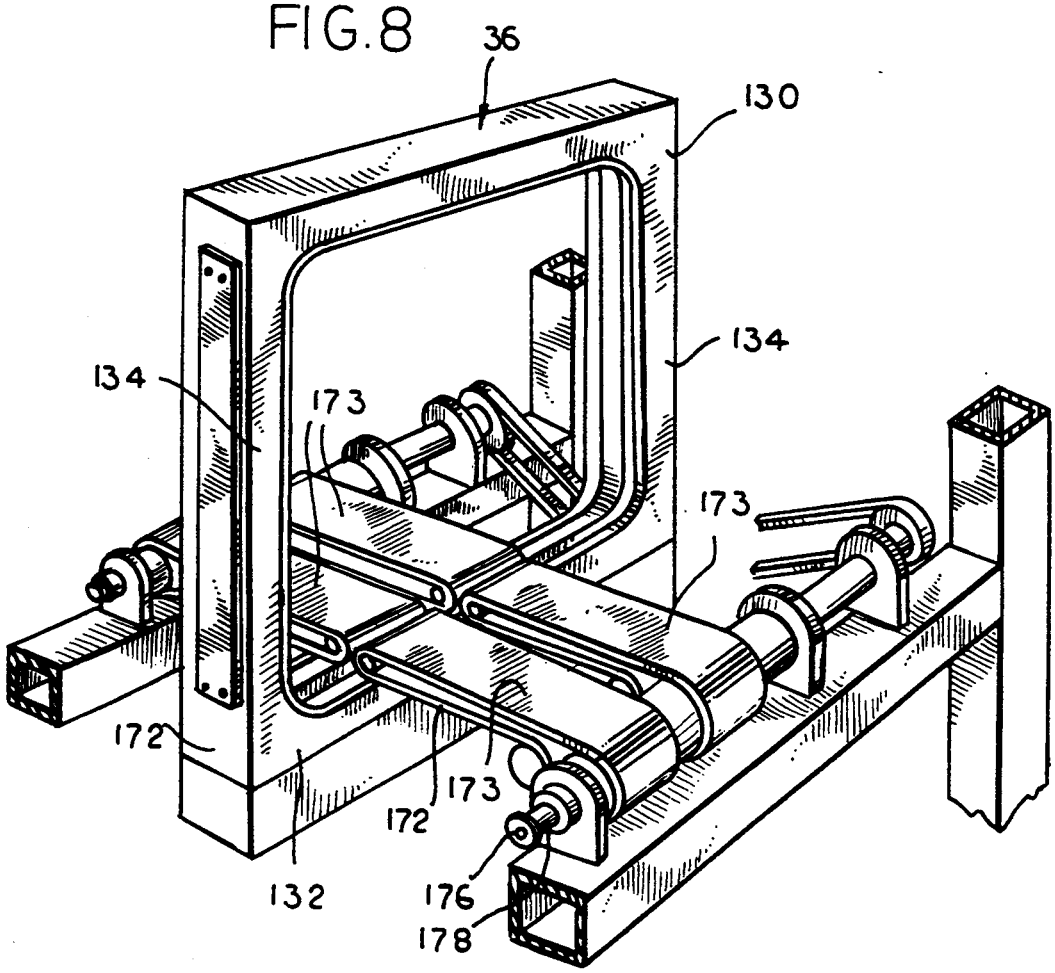
FIG. 8 is a fragmentary perspective view of the machine without the soft touch compression device attached.

Another important feature is that the packages may be moved through the machine 20 in a back-to-back relationship, as shown in FIG. 6. This is accomplished by using an encoder sensor 176, as shown in FIG. 8, for sensing package location. The encoder 176 is located on the conveyor belt shaft 178 and is used to count the number of revolutions of the shaft 178. The machine is pre-programmed by the user to set a pre-determined number of revolutions that are necessary to move the package 22 into the position to be strapped. The encoder 176 is in communication with the sensors 174 by way of the control system 81. When one of the sensors 174 is activated by a package 22 moving into the machine 20, it sends a signal to the control system 81 which signals the encoder 176 to start counting the number of revolutions of the conveyor belt shaft 178 in order to determine the package location in the machine 20. When the encoder 176 counts a predetermined number of revolutions, it signals the control system 81 that the package 22 is in the proper position to be strapped. After the package 22 is strapped, the conveyors 172 move the package 22 out of the machine 20 and the process repeats itself. If the sensor 174 senses a space between the packages 22, a signal is sent to the control system 81 which signals the encoder 176 to stop counting.

Once the package 22 has been moved into the chute assembly 36, a plurality of package conditioners 180 and stops 182 move the package 22 into the proper strapping position in the machine 20. As the package 22 enters the chute assembly 36, the control system 81 signals the stops 182 to move into a contacting position 183 with the front end of the package 22, as shown in solid lines in FIG. 7. After the stops 182 stop the package 22 in the chute assembly 36, the control system 81 signals the conditioners 180 to move into a contacting position 185 with respect to each side 186 of the package 22 upon opposite sides of the package centerline 142. Thus, the conditioners 180 and stops 182 cause the package 22 to be moved into a square position for strapping. More conditioners 180 and stops 182 may be used than the amount shown in FIG. 7 depending upon the size of the package 22.

The conditioners 180 and stops 182 are actuated by air cylinders 184. Each conditioner 180 may have an individual air cylinder 184 or the conditioners 180 may be attached to a T-bar assembly, not shown, on each side and actuated by a single air cylinder. After the package 22 has been strapped, the control system 81 signals the conditioners 180 and stops 182 to move into the retracted position 187, as shown in broken lines in FIG. 7, by activating the air cylinders 184.

An additional feature of note is that the entire machine 20 is mounted on wheels 188. This allows the machine 20 to be portable.

The dual coil power strapping machine control system 81 uses a keypad 170 input to choose optional machine operations. Some items that can be turned on or off from the keypad 170 are package compression, package stops, side conditioners, conveyors, strap high tension, and an optional output printer. This system replaces previous designs that used selector switches to choose the functions. The keypad 170 also allows digital selection of the values for the various items such as, for example, the strapping head functions, strap placement, overall timers for strap feed time, strap take-up time, strap tension time, and the like.

The control system 81 also has a two-line alphanumeric display, not shown, located at both operator positions on both sides of the machine 20. The control system 81 may also be provided with a light tree 190 that signals the operating status of the machine 20. Different lights on the tree 190 can be turned on or off when certain machine functions are occurring. Previous and current designs only have operator information at one operator position.

A battery backed RAM may be incorporated in the control system 81 and provides for retention of performance data over certain periods of time. Some of the data that is available is the number of cycles, number of failures, number of shutdowns, and a preventative maintenance schedule, along with a date and time stamp.

The control system 81 may also be provided with a plug-in port for items such as a laptop computer, printer, or a customer monitoring center. Such a port can be used for downloading machine information for future use by the customer. The control system 81 also has modem capabilities for transferring machine information to and from the machine 20 to the customer's control center. The machine 20 can also be reprogrammed through this modem from off-site locations.

With the specifics of the machine 20 having been disclosed, the method of operation will now be discussed.

Initially, an operator must manually feed both straps 38 into the guide apparatus 32 from the coils 40 and 42. One strap 38 passes through the gate 62, while the other strap 38 waits to be automatically fed when needed. The proximity sensor 88 at the gate 62 signals the control system 81 as to which coil 40 or 42 is being used and the strap feed mechanism 74 or 75 for the appropriate coil 40 or 42 starts rotating.

The strap 38 is driven through the guide apparatus 32 toward feed drive rollers 116. The rotating guide 64 is closed at this point, so that the strap 38 is directed through the tension rollers 120, the high tension winder 118, the feed drive rollers 116, and the strapping head 106. As the strap 38 reaches the head 106, it starts the strap feed timer when machine 20 begins feeding into the chute apparatus 36, and the rotating guide 64 elements are simultaneously rotated into the open position.

The feed drive rollers 116 advance the strap 38 around the closed chute apparatus 36 through the slot 140. After the strap 38 completes the loop, the sensor 144 is tripped, and the feed drive rollers 116 stop. However, until the sensor 108 is actuated, the strap feed mechanism 74 or 75 continues to operate and feeds extra strap 38 into the strap storage area 102.

An unstrapped package 22 travels into the chute apparatus 36 on the conveyor belts 172. The upstream height sensor 168 senses the height of the package 22 and positions the soft belts 154 accordingly. The first non-contacting sensor 174 on the entrance conveyor confirms that a package 22 has entered the machine 20.

The encoder 176 counts off a predetermined number of revolutions of the shaft 178 in order to move the package 22 into the chute apparatus 36. The package stops 182 are moved into the contacting position 183 by the air cylinders 184 and contact the package 22 as it moves through the machine 20. After the package 22 is stopped by the package stops 182, the package conditioners 180 engage the package 22 by actuating the air cylinders 184 in order to properly position the package 22 for strapping.

After the package 22 is properly positioned at the work station, the soft belts 154 are moved downward as the chain drives 150 rotate around the sprockets 158 by the action of the air cylinder 152 on the carriages 162. The soft belts 154 compress the package 22 on either side of the strap centerline 142 and create a flat top region 166 for placement of the strap 38.

The track pieces 136 and 137 of the chute apparatus 36 are then separated by the air cylinders 126, and the strap 38 drops onto the soft brushes 128. The tension drive wheels 120 are actuated in sequence so as to pull strap 38 into the strap take-up area 104. The strap 38 is pulled through the brushes 128 and onto the flat surface of the package 22 and the high tension winder 118 may be actuated until the strap 38 is at the desired tension.

The strap 38 is then welded and severed by the strapping head 106 in a known manner, whereupon the soft belts 154 are moved upward by the air cylinder 152 and the package conditioners 180 and stops 182 are moved outward by the air cylinders 184. The strapped package 22 is then moved out of the machine 20 by the conveyor belts 173 on the discharge side of the chute apparatus 36. The machine 20 is ready for the next package 22, and the process repeats itself.

The process will keep repeating itself until the out-of-strap sensor 110 or 111 senses the end of the strap 38 upon the particular coil 40 or 42. When the end of the strap 38 is sensed, the strap feed mechanism 74 or 75 stops rotating, and the electromechanical brake 114 or 115 is engaged with the coil 40 or 42 so as to stop the coil 40 or 42 from rotating. The machine 20 continues strapping packages 22 with the remaining strap 38 in the strap take-up area 104 and the strap storage area 102. When the sensor beam 108 is unbroken in the strap storage area 102, this signals the strap feed mechanism 74 or 75 to rotate in the opposite direction, and the remaining short piece of strap 38 is expelled from the guide apparatus 32, and the rotating guide 64 rotates to the closed position. The machine 20 then automatically feeds the other strap 38 through the gate 62 by rotating the appropriate strap feed mechanism 74 or 75, and starts the strapping process again.

When the strap storage area 102 is full, the beam from the photoelectric emitter and receiver sensor 108 is broken. The strap feed mechanism 74 or 75 stops rotating and the electromechanical brake 114 or 115 is engaged with the coil 40 or 42 to stop the coil 40 or 42 from rotating. The machine 20 continues strapping with the strap 38 in the strap take-up area 104 and the strap storage area 102 until the beam path is again cleared. Once the beam 108 is unbroken, the strap feed mechanism 74 or 75 starts to rotate again and feeds extra strap 38 into the strap storage area 102. When this area 102 is full, the beam 108 is broken and the process repeats itself until the coil 40 or 42 is empty.

If the strap proximity sensor 144 senses a short feed or a misfeed, then the strap feed mechanism 74 or 75 is stopped from feeding strap 38 into the machine 20 and the electromechanical brake 114 or 115 is engaged with the coil 40 or 42 to stop the coil 40 or 42 from rotating. After the coil 40 or 42 has stopped rotating, the brake 114 or 115 is disengaged to allow the coil 40 or 42 to freely rotate for the next sequence. The linear solenoid 56 or 57 pivots the coil rewind motor 54 or 55, and the frictional wheel 58 or 59 engages the coil 40 or 42 and rotates the coil 40 or 42 in the reverse direction. The strap 38 is pulled out of the machine 20 as it is rewound onto the coil 40 or 42. The strap 38 is rewound until the out-of-strap switch 110 or 111 senses the end of the strap 38 whereafter the rotating guides 64 close. This signal from the out-Of-strap switch 110 or 111 also activates the electromechanical brake 114 or 115 to stop the rotation of the coil 40 or 42. A control light 112 is activated on the control panel 81 to signal the operator to load a new coil 40 or 42 or to attempt a reload.

After the strap 38 is rewound, the machine 20 automatically starts the other strap feed mechanism 74 or 75 rotating and feeds the other strap 38 into the guide apparatus 32. The machine 20 then continues strapping packages 22.

While a preferred embodiment of the present invention has been shown and described, it is envisioned that those skilled in the art may devise various modifications of the present invention without departing from the spirit and scope of the appended claims. The invention is not intended to be limited by the foregoing disclosure, and therefore, within the scope of the appended claims, the present invention may be practiced otherwise than as specifically described herein.

What is claimed is:

1. A machine for strapping articles, comprising:

a support;

strap positioning means mounted upon said support for guiding a strap around an article to be strapped;

strap applying means mounted upon said support for feeding strap to said positioning means and then tightening said strap;

strap guiding means mounted upon said support for selectively, alternately guiding a plurality of separate straps from a plurality of sources of supply toward said strap applying means;

said guiding means including at least two branches converging to a point and a third branch extending from said point toward said applying means, and a gate element shiftable between a first and a second position for selectively allowing only a single strap, of said plurality of straps, at any one time to pass through said point and into said third branch;

means for sensing the position of said gate element and thereby identifying the particular one of said straps passing through said point; and means responsive to said means for sensing for feeding the identified strap toward said strap applying means.

2. A machine is defined in claim 1 wherein said means for feeding includes feed rollers for advancing strap through said branches.

3. A machine as defined in claim 1 further including means for sensing an end of a strap, and means responsive to said means for sensing an end of a strap, for retracting the strap toward the source when the end of the strap is sensed.

4. A machine as defined in claim 1 which further includes a compartment for receiving strap;

a part of said third branch of said guide means extending through said compartment such that the compartment is divided into first and second separate storage areas, and said part of said third branch including shiftably supported sections movable between a first position for guiding strap directly to said applying means and a second position for directing strap into said first compartment area and then to said applying means.

5. A machine as defined in claim 4 which further includes a sensing means means associated with said first storage area for sensing when the first storage area is full, and means responsive to said sending means for stopping feeding of strap from a source of supply when said first storage area is full.

6. A machine as defined in claim 5 wherein said sensing means comprises a photoelectric emitter and receiver.

7. A machine as defined in claim 1 which includes a sensing means associated with said strap positioning means for sensing whether a strap has been advanced entirely around the strap positioning means within a predetermined time for controlling subsequent operation of the applying means.

8. A machine as defined in claim 1 which includes means including sensing means associated with said sources of supply for sensing when all of the strap has been exhausted from one source of supply and subsequently feeding strap from another source of supply.

9. A machine as defined in claim 1 further including conveying means for moving the article to and from the strap positioning means.

10. A machine as defined in claim 9 which includes a sensing means associated with said conveying means for sensing the presence of an article at said positioning means.

11. A machine as defined in claim 9 which includes a sensing means associated with said conveying means for sensing a location of the article as the article travels through the machine.

12. A machine as defined in claim 11 wherein said sensing means comprises an encoder.

13. A machine as defined in claim 1 which further includes a means for properly positioning the article in the strap positioning means.

14. A machine as defined in claim 13 wherein the means for properly positioning the article comprises retractable package conditioners and stops.

15. A machine as defined in claim 1 wherein said plurality of sources comprises rotatable spools.

16. A machine as defined in claim 15 which further includes a plurality of means including drive means respectively associated with said spools for selectively retracting strap onto a spool in response to a short feed or a misfeed of the strap.

17. A machine as defined in claim 1 wherein said positioning means includes a chute, said chute comprising a frame for encircling an article to be strapped;

opposing guide tracks including complementary strap accommodating slots and mounted on said frame for relative movement between closed and open positions; said guide tracks being positioned around a centerline of the strap when in the closed position;

said guide tracks retaining the strap therein when in the closed position and releasing the strap to fall therefrom in the open position, and activating means connected to said guide means for causing said movement between said closed and open positions.

18. A machine as defined in claim 17 wherein when said guide tracks are in the open position, the strap can move radially inwardly toward said article.

19. A machine as defined in claim 17 wherein said activating means comprises an air cylinder.

20. A machine as defined in claim 17 further including retaining means located between said guide tracks and an article to be strapped for holding strap outside of said guide tracks after the guide tracks have opened.

21. A machine as defined in claim 20 wherein said retaining means comprises resilient, flexible members disposed at opposite sides of a strap centerline for enabling strap to be easily pulled therefrom during a strapping operation.

22. A machine as defined in claim 1, further including an article compression apparatus for compressing an article to be strapped, disposed at a work station, comprising:

a transfer shaft mounted so as to extend between opposite sides of said work station;

carrier means disposed at said opposite sides of said work station and connected to opposite ends of said transfer shaft;

drive means connected to said transfer shaft for rotation of said transfer shaft;

a soft compression member traversing said work station and connected to said carrier means; and activating means for causing movement of said carrier means.

23. A machine as defined in claim 22 wherein said compression member comprises a flexible belt.

24. A machine as defined in claim 22 wherein each of said carrier means comprises a chain drive.

25. A machine as defined in claim 22 wherein said activating means comprises a pneumatic cylinder connected with one of said carrier means.

26. A machine as defined in claim 22 which further includes a means for allowing relative motion between the carrier means.

27. A method for strapping articles comprising the steps of:

feeding a plurality of straps from a plurality of sources through first and second guides means toward a converging point having a gate element shiftable between a first and a second position;

selectively engaging the gate element by one of said straps for positioning said gate element in one of said positions, and passing said one strap to a third guide means;

sensing the position of the gate element for identifying which strap is passing through said converging point;

actuating a feeding means for advancing said last-mentioned strap through said third guide means;

feeding said last mentioned strap to a strap positioning means for encircling the article, and applying said last mentioned strap to the article.

28. A method as defined in claim 27 further including the steps of:

advancing said one strap through a storage compartment area to the strap positioning means, and subsequently dividing said compartment into a first storage area for receiving additional strap from a feeding means and a second storage area for receiving strap retracted from the positioning means during application of the strap to the article.

29. A method as defined in claim 28 further including the steps of:

sensing when the first storage area is full, and stopping the feeding of said one strap from the source when said first storage area is full.

30. A method according to claim 28 further including the steps of:

timing the advancement of said last mentioned strap, around an article at the positioning means and sensing the strap for completion of the step of encirclement of an article, and applying the strap to the article when the encirclement has been completed within a predetermined time and alternatively retracting the strap toward the source when the encirclement has not been completed within said predetermined time.

31. A chute for use in an article strapping apparatus comprising:

a frame for encircling an article at a work station;

opposing guide tracks mounted on said frame for relative movement between closed and open positions, said tracks including complementary slots for receiving strap;

said guide tracks being positioned around a centerline of the strap when in the closed position;

said guide tracks retaining the strap therein when in the closed position and releasing the strap to fall therefrom in the open position, and activating tracks connected to said guide means for causing said movement between said closed and open positions.

32. A chute as defined in claim 31 wherein when said guide tracks are in the open position, the strap can move radially inwardly toward said article.

33. A chute as defined in claim 31 wherein said activating means includes an air cylinder.

34. A chute as defined in claim 31 further including resilient retaining means connected to said frame for holding the strap outside of said guide tracks after the guide tracks have opened.

35. The chute as defined in claim 34 wherein said retaining means comprises flexible fingers.

36. The chute as defined in claim 34 wherein said retaining means comprises brushes.

37. The chute as defined in claim 34 wherein said retaining means comprises resilient elements at each side of the track centerline and inclined away from an adjacent guide track toward said centerline for maintaining a strap in a desired centered position.

38. The chute as defined in claim 31 wherein said frame includes the side and top and bottom pieces meeting at corners;

said corners being curved, and portions of said top, bottom, and side pieces between said corners being substantially straight.

39. The chute as defined in claim 31 wherein said slot has a greater width than a width of said strap.

40. The chute as defined in claim 31 wherein when said chute is in the open position, the guide tracks have a greater width between the guide tracks than a width of the strap.

41. An article compression apparatus, for use in an article strapping apparatus, for compressing an article to be strapped at a work station, comprising:

a transfer shaft mounted so as to extend between opposite sides of said work station;

carrier means disposed at said opposite sides of said work station and connected to opposite ends of said transfer shaft for movement in unison with said transfer shaft;

drive means for rotating said transfer shaft; and a soft compression member traversing said work station and connected to said carrier means.

42. A compression apparatus as defined in claim 41 wherein said compression member comprises a flexible belt.

43. A compression apparatus as defined in claim 41 wherein each of said carrier means comprises a chain drive.

44. A compression apparatus as defined in claim 41 wherein said drive means comprises a pneumatic cylinder connected with one of said carrier means.

45. A compression apparatus as defined in claim 41 which further includes a means for allowing relative motion between the carrier means.

* * * * *